United States Patent [19]

White

[11] Patent Number: 4,537,145

[45] Date of Patent: Aug. 27, 1985

[54] WIND PROPELLED VESSEL

[76] Inventor: Christopher R. White, 48 Bush St., South Dartmouth, Mass. 02748

[21] Appl. No.: 587,247

[22] Filed: Mar. 7, 1984

[51] Int. Cl.[3] ..... B63B 15/02

[52] U.S. Cl. ..... 114/91; 114/39; 114/98; 114/61

[58] Field of Search ..... 114/39, 89, 90, 91, 114/97, 98, 102, 61

[56] References Cited

U.S. PATENT DOCUMENTS

| | | | |
|---|---|---|---|
| 830,720 | 9/1906 | Jensen | 114/91 |
| 1,856,804 | 5/1932 | Blackman | 114/91 |
| 3,487,800 | 1/1970 | Schweitzer | 114/91 |
| 3,807,333 | 4/1974 | Ross | 114/91 |
| 3,972,300 | 8/1976 | Adamski | 114/91 |
| 3,985,106 | 10/1976 | Ross | 114/91 |
| 4,102,287 | 7/1978 | Ferris | 114/91 |
| 4,159,006 | 6/1979 | Thurston | 114/39 |

FOREIGN PATENT DOCUMENTS

| | | | |
|---|---|---|---|
| 75208 | 3/1983 | European Pat. Off. | 114/91 |
| 1005089 | 4/1952 | France | 114/91 |
| 7735675 | 6/1979 | France | 114/91 |
| 140071 | 9/1920 | United Kingdom | 114/91 |

*Primary Examiner*—Galen L. Barefoot
*Assistant Examiner*—C. T. Bartz
*Attorney, Agent, or Firm*—John F. C. Glenn

[57] ABSTRACT

Sailing vessel having mast and sail tiltable fore and aft and athwartship. The mast is held at an intermediate place along its length, and its lower end is swingable about the intermediate holding means.

11 Claims, 11 Drawing Figures

FIG. 3
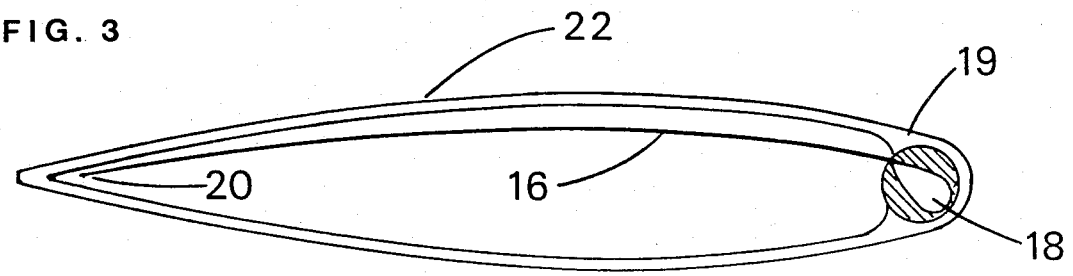
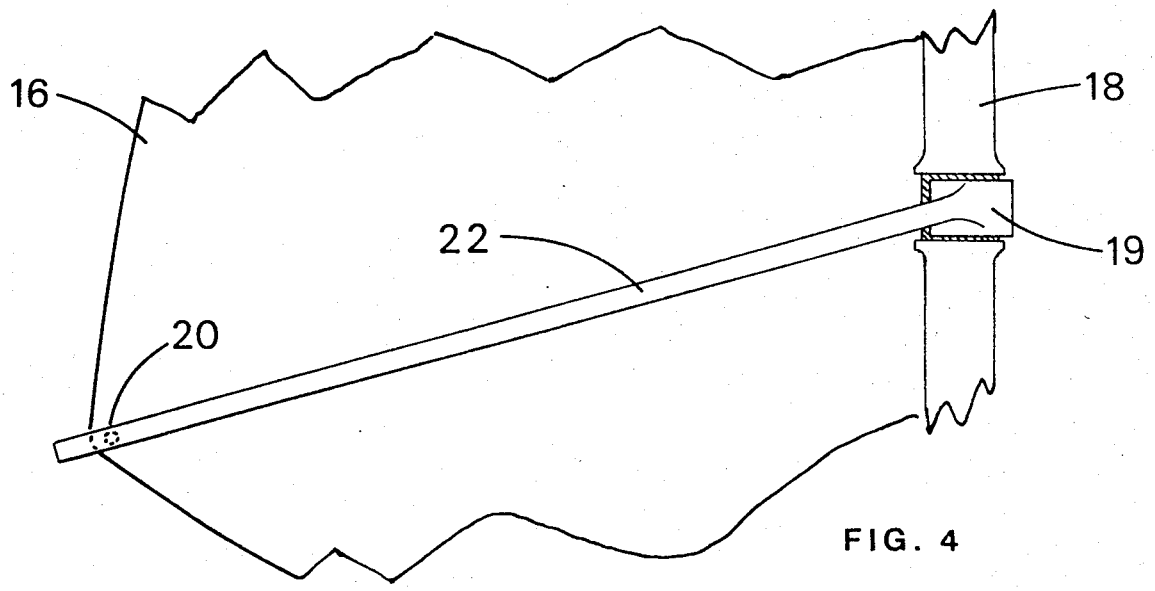
FIG. 4
FIG. 5
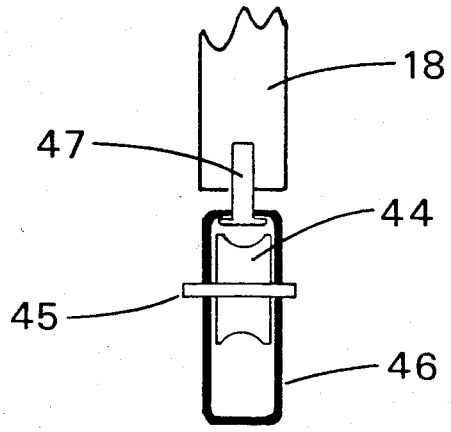
FIG. 6
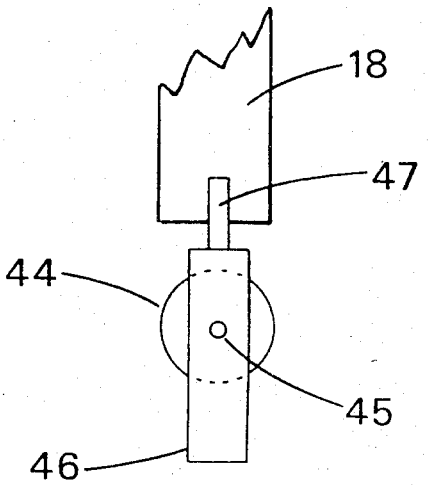

WIND PROPELLED VESSEL

BACKGROUND OF THE INVENTION

Since the earliest days of seafaring, increased speed of sailboats has been sought. In recent times, the demand for very high speed sailing craft by recreational sailors has created a large boatbuilding industry specifically to provide extremely fast sailing craft.

Previous efforts at the design of high speed sailboats have centered on one or more of the following steps to reduce the frictional and wave making resistance of the hull(s): vessel weight reduction, efficient hull forms (i.e., catamarans and planing hulls), or hydrofoils with which the hull is lifted out of the water. All of these methods have increased sailing speed to some extent. However, the most dramatic speed breakthrough in many years has been achieved by the sailboard. This vessel consists of a surfboard-shaped hull to which a freely pivoting mast and sail is attached. The sail is restrained only by the operator; see U.S. Pat. No 3,487,800 of Schweitzer and Drake (1970). A direct consequence of the "Free Sail System" of Schweitzer and Drake is that in strong winds the operator inclines the sail to windward, rather than allowing the sail to heel away from the wind as is the case with all conventionally rigged sailboats. Because the wind-induced force of a sail (or aerofoil) is always perpendicular to its surface, when the sailboard sail is inclined to windward it has a portion of this force directed upwardly against the downward force of gravity. This upward force lifts the hull partially (or even completely) out of the water, thereby reducing its fricitional and wave making resistance, and increased speed results.

This concept is well documented. There are examples of sailing vessels designed to utilize "lift" producing sails dating back to the 1800's.

Of all the previous attempts at "lifting sails", only the "Free Sail System" of Schweitzer and Drake allows the sail to swing about all three of the major axes, extending fore and aft, athwartships, and up from the deck. However, the mast is pivoted at its base about a socket in a fixed position on the deck. It is desirable that the said be readily pivotable about all three axes for the following reason. As the said is shifted to windward of the vessel, it causes an imbalance of forces commonly known as "lee helm", which is the tendency of the vessel to turn away from the wind. To correct this problem, the said must be tilted farther aft. This will bring the drive and drag producing forces back into equilibrium and the vessel will steer straight ahead.

The limiting condition of the "Free Sail System" is that it must be "substantially free from pivotal restraint", meaning that the operator actually holds the sail up against the wind without the help of any mechanical devices. This causes the sailboard to be very strenuous to operate and further confines its tri-axis control "lifting sail" concept to very small vessels with very small sails.

These developments have left unsolved the problem of how to obtain the benefits of a sail controllable about all three major axes in a manner suitable for use on larger, more stable sailing vessels.

SUMMARY OF THE INVENTION

The present invention provides the operator of a sailboat with accurate and sensitive control over the position of the sail, which can be inclined athwartship, tilted fore and aft, or rotated about the mast. Sail movement in any direction can be accomplished independently from or simultaneously with tilting or inclination in any other direction.

The degree of movement in any direction can be restricted to the normal range of sailing usage. This prevents the sail from falling into the water or otherwise moving too far.

Athwartship inclination, and fore and aft tilting can be accomplished with or without mechanical advantage, depending on the size of the vessel.

Other details and advantages of the invention will become apparent as the following description of the embodiment thereof in the accompanying drawings proceeds.

A BRIEF DESCRIPTION OF THE DRAWINGS

FIG. 3 is a sectional view of the wishbone boom, mast, sail and gooseneck.

FIG. 4 is a profile view of the wishbone boom, mast, sail and gooseneck.

FIG. 5 is a sectional view of the lower end of the mast and the roller device.

FIG. 6 is a profile view of the lower end of the mast and the roller device.

Figure 1:
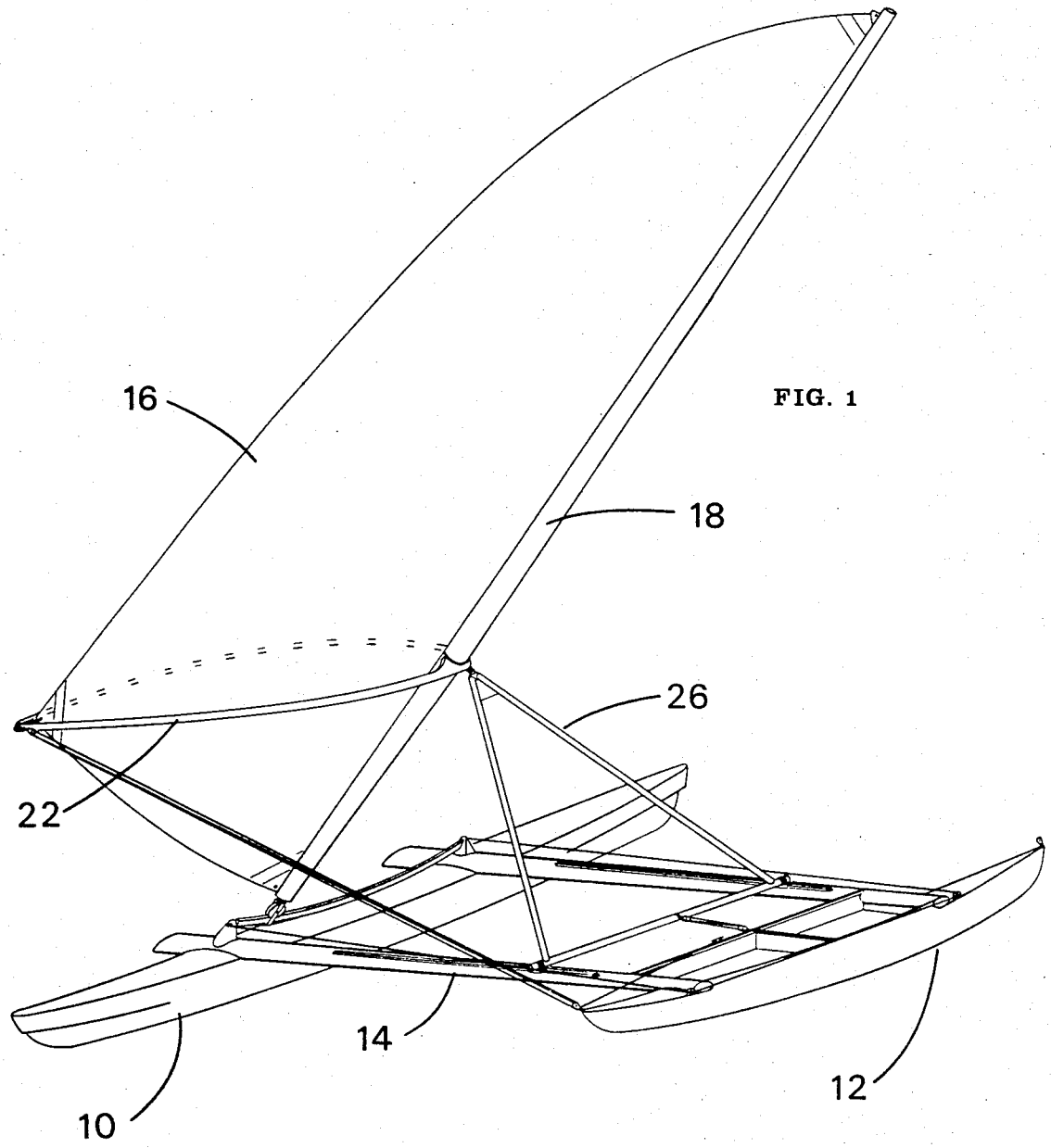
FIG. 1 is a perspective view of a sailing vessel embodying the invention.
Figure 2:
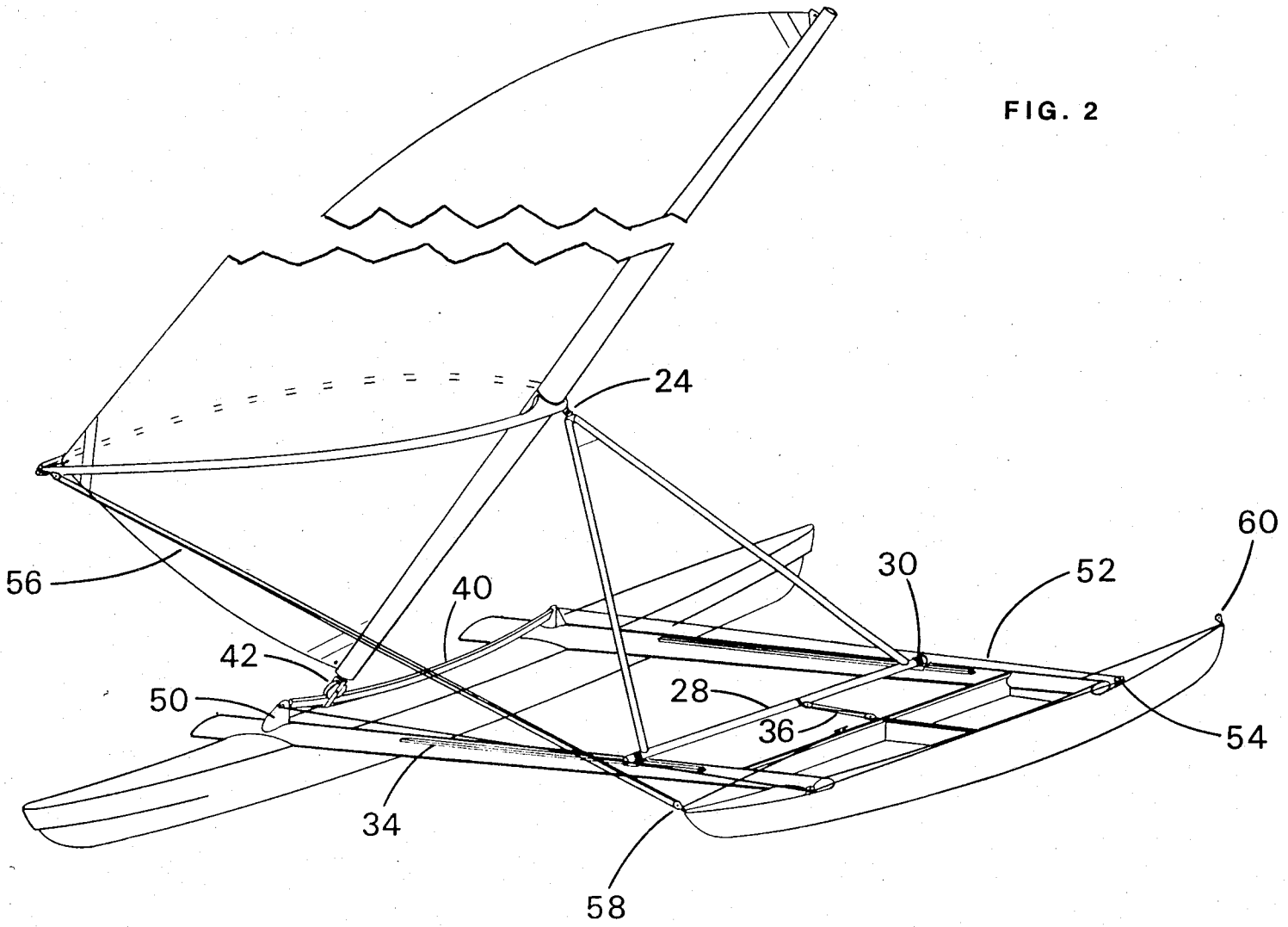
FIG. 2 is an enlarged view of FIG. 1.
Figure 7:
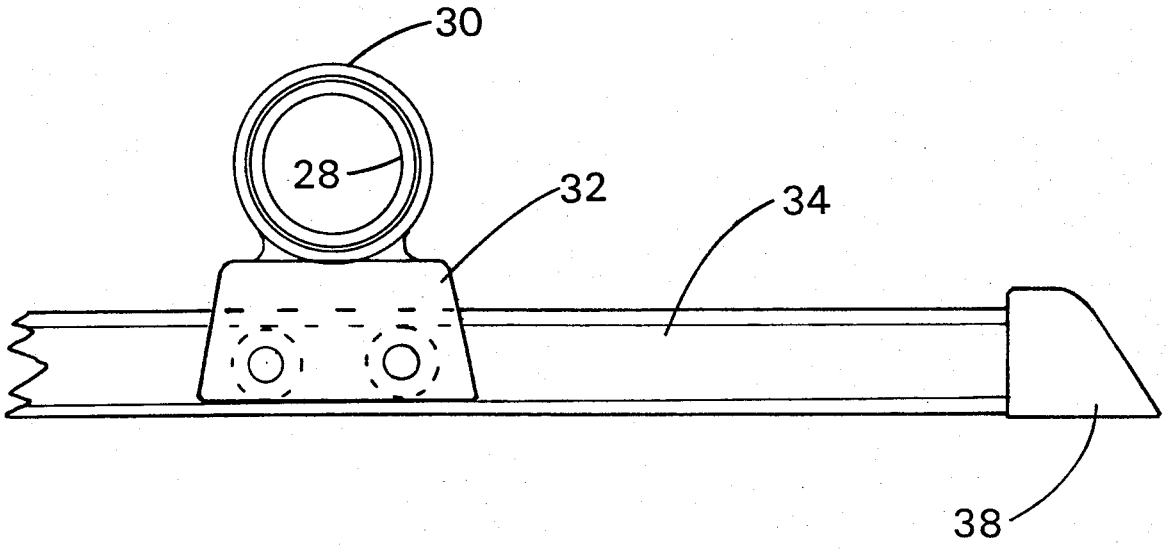
FIG. 7 is a side view of the "I" beam track, ball bearing car, and end stop. It also shows a section of the lower member of the upper mast holding means and its mounting sleeve.
Figure 8:
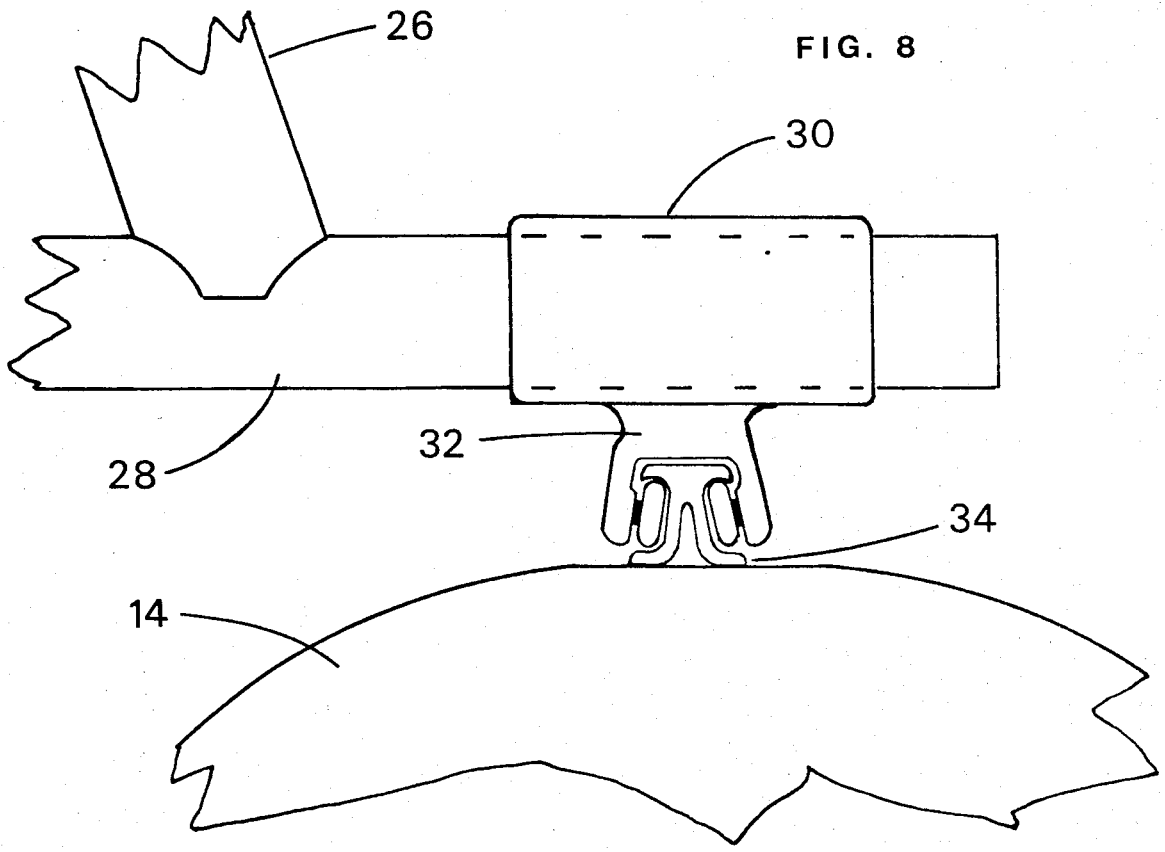
FIG. 8 is a sectional view of the "I" beam track, ball bearing car and crossbeam. It also shows a portion of the upper mast holding means and its mounting sleeve in profile.
Figure 9:
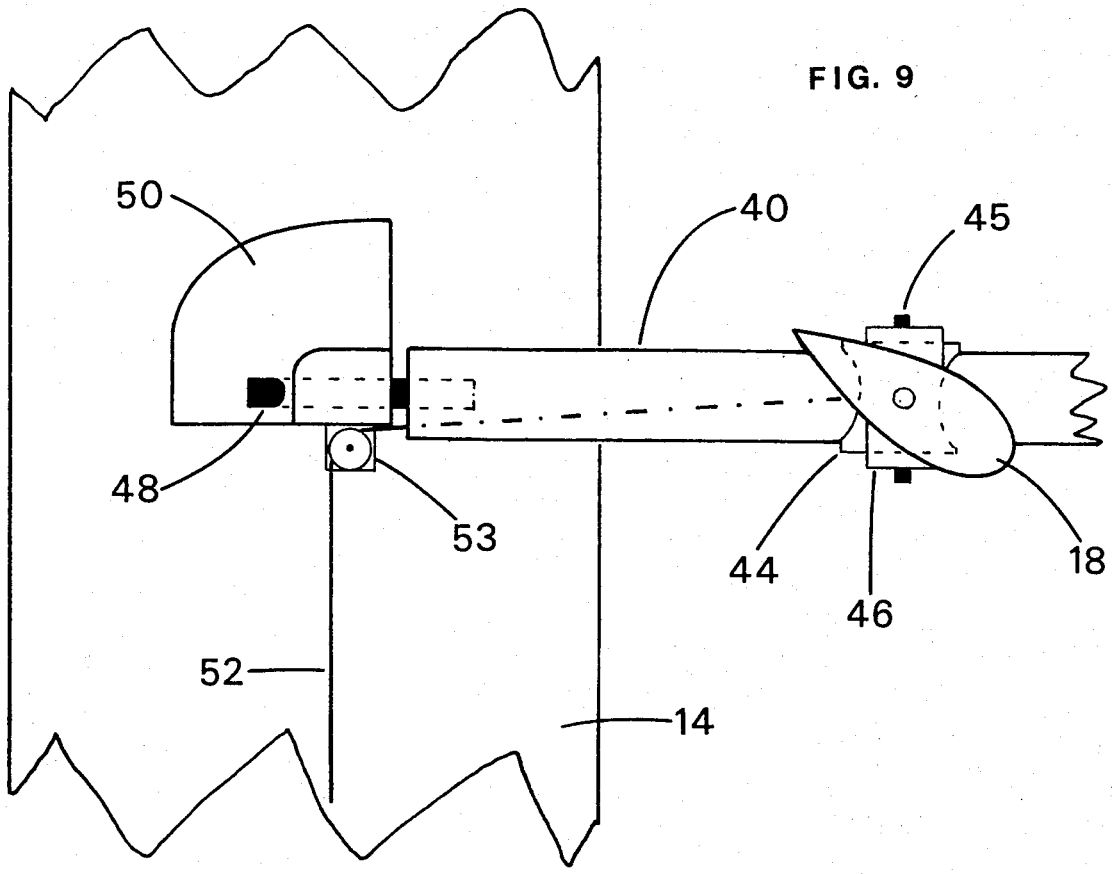
FIG. 9 is a plan view of the lower mast holding means, supporting pylon, crossbeam, and control line.
Figure 10:
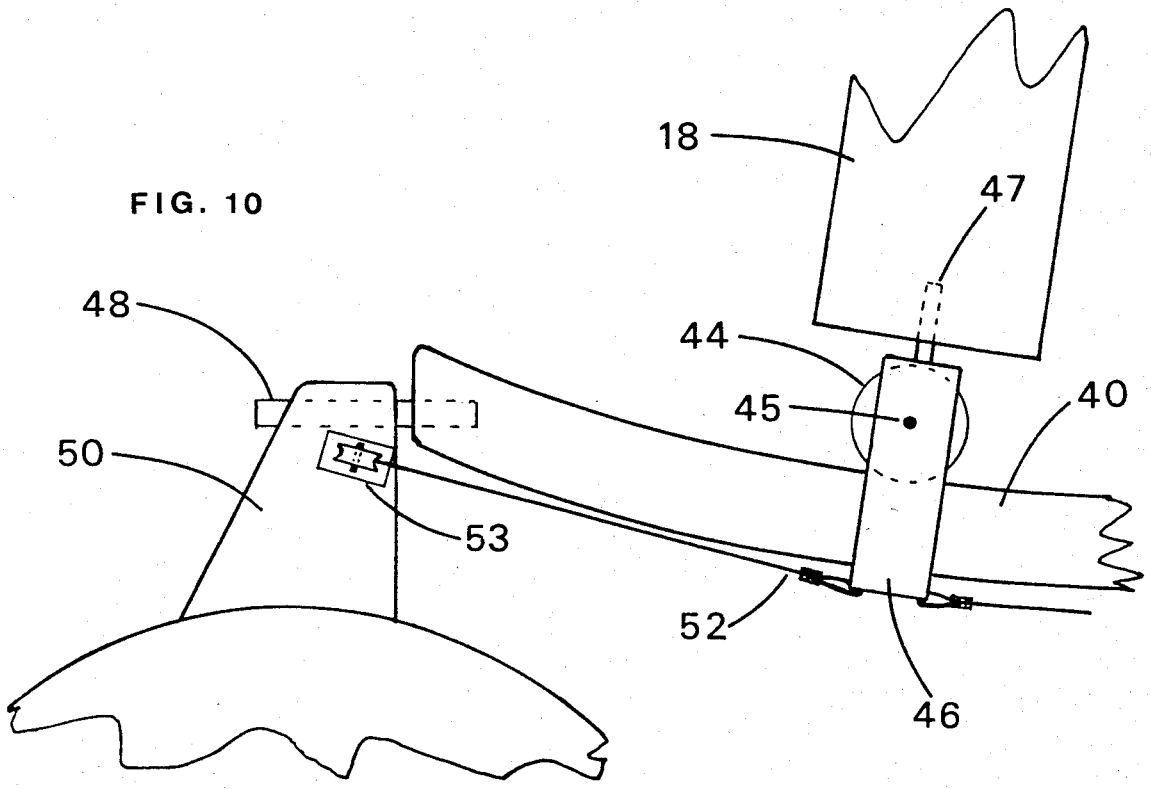
FIG. 10 is a profile view of the lower mast holding means, supporting pylon, crossbeam and control line.
Figure 11:
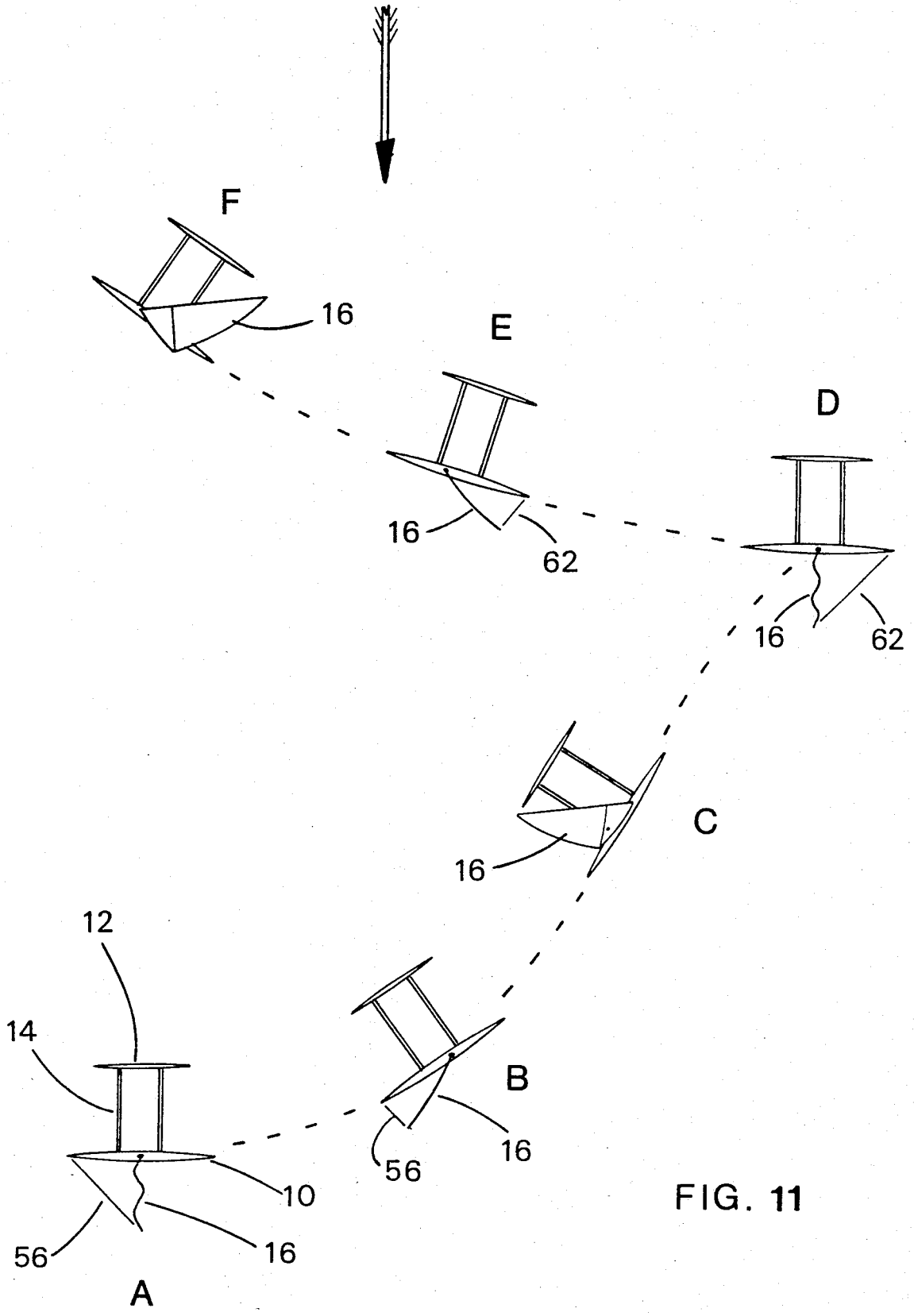

FIG. 11 illustrates the procedure of sailing against the wind in a Pacific proa, which is the vessel demonstrating the present preferred embodiment of the invention. The wind direction is shown by the arrow at the top of the figure. The view is from directly above the vessel in a series of positions from A to F.

DETAILED DESCRIPTION OF THE PRESENT PREFERRED EMBODIMENTS

The type of sailing vessel chosen to demonstrate the present preferred embodiment of the invention is generally known as a "Pacific proa". It comprises an elongated main hull 10 and a shorter elongated float 12 which are firmly secured together in a parallel relationship with two crossbeams 14. The unique feature of the Pacific proa, for which the invention is well suited, is that the boat is always sailed with the float 12 on the windward side. In order to sail against the wind and maintain this relationship, the normal maneuver of tacking is modified. The procedure for tacking a Pacific proa involves stopping the forward motion of the vessel, reversing the direction of the sail, repositioning the steering devices (if any), and then proceeding to sail "backwards". To accomplish this feat, the Pacific proa is designed to be symmetrical about its midpoint along its length. Both ends of the boat are the same and can be used as either bow or stern.

A triangular sail 16 is secured along one side to a mast 18. The methods commonly used to join the sail to the mast are: slides on a metal track, slides in a groove, or a fabric sleeve along the edge of the sail through which the mast is inserted.

The other two sides of the sail converge toward a point 20, which is fastened to the end of a boom 22. The boom 22 is preferably of the wishbone type, secured to the mast by means of a "gooseneck" fitting 19. This connection preferably permits 120° rotation of the mast 18 about its central axis without a change of direction of the boom 22. This feature allows a streamlined mast section to be used to best advantage.

Inclination of the mast 18 in an athwartship direction is accomplished by using a universal joint 24 to couple the boom 22 to the upper mast holding means 26. The universal joint 24 can be of the ball and socket type, or more simply a short length of synthetic cordage which is firmly adhesive bonded to both the boom and the upper mast holding means 26. (Alternately, the universal joint 24 can be fastened to the mast directly.) The upper mast holding means 26 comprises a rigid triangular structure preferably made of aluminum pipe welded together. The lower, horizontal member of this triangular structure 28 extends beyond the joint with the vertical members and freely through sleeves 30 which are fixed to ball bearing cars 32 which ride on extruded aluminum "I" beam tracks 34. Tracks 34 being firmly affixed to crossbeams 14 and spaced parallel to each other. The ball bearing car 32 and "I" beam tracks 34 are the kind commonly sold as sailboat mainsheet adjusting devices.

In use, the sail will tend to slide the lower member 28 toward the main hull 10. To overcome this pull and to obtain sensitive control over the inclination of the sail 16, a block and tackle 36 is fixed from the lower member 28 to the float 12. Adjustment of the tackle 36 can readily be made by the operator of the vessel, who will normally be seated on the float 12. The ball bearing car 32 can be restrained from coming off the ends of the "I" beam track 34 by the use of end stops 38.

Fore and aft tilting of the mast 18 is accomplished by mounting the lower end of the mast 18 to a track 40 by means of a roller device 42. The roller 44, preferably Delrin$^{tm}$ plastic, turns on an axle 45. The roller cage 46 prevents it from slipping off the track 40. The lower end of mast 18 fits over a stud 47 on roller cage 46, so that the mast 18 can be rotated about its central axis while at any angle of inclination relative to hull 10.

For best sensitivity, the track 40 should be constructed with curvature conforming to that obtained by swinging an arc from universal joint 24. In addition, track 40 should pivot freely on pins 48 which are supported by pylons 50, so that track 40 is always properly aligned with the mast 18 as it is inclined by moving the horizontal member 28.

The function of roller device 42 is to permit rapid adjustment of the base of the mast 18 to any location along the track 40. This causes the portion of the sail 16 above the joint 24 to be shifted forward or aft while the lower portion, which is smaller, to shift in the opposite direction, assuming that joint 24 is held steady.

Adjustment and locking of the position of roller device 42 along track 40 is accomplished by the use of control line 52. Control line 52 is preferably an endless loop which is fixed to the lower portion of roller cage 46 from whence it travels along the underside of track 40, to lead blocks 53 and 54. Control line 52 can be held steady or adjusted by the operator sitting on float 12. For convenience, a cleat or clamp may be provided to hold line 52 in any desired position.

The third direction of sail 16 movement is rotation about the lengthwise axis of the mast 18. This movement is similar to the "sheet" control on all conventional sailboats. The angular position of the sail with respect to the centerline of the vessel is controlled by adjustment of the length of line 56 which is connected from float 12 at lead block 58 to the end of boom 22. In order to sail in the opposite direction, line 56 is led to float 12 through lead block 60. In practice, lead block 60 would have its own control line, eliminating the need to remove the line 56 from lead block 58 and transfer it to lead block 60.

The following brief description of the sailing procedure illustrates the method of using the above described vessel. FIG. 11 illustrates the procedure of sailing against the wind, including the method of tacking peculiar to the Pacific proa. The view is from directly above the vessel in a series of positions A to F. The direction of the wind is shown by the arrow at the top of the figure.

In position A, the vessel is positioned directly across the wind with the float 12 to the windward side. The sail 16 is allowed to weathercock into the wind so that it is not causing the boat to move. The mast 18 is positioned approximately vertical without any inclination or tilting.

To proceed ahead, control line 56 is tightened, pulling the sail 16 to an angle against the wind. As the vessel gathers headway it will be necessary to steer more directly into the wind. This is done by tilting the body of the sail 16 aft, as shown at B, which causes the boat to turn toward the wind. Any time the wind strength and direction permits, the mast may be inclined to windward, as shown at C, to help lift the hull from the water. Minor adjustments can be made in the fore and aft tilting angle of the sail in order to keep the vessel pointed in the desired direction.

In order to tack, it is necessary to reverse the direction of the boat. This is done in the following manner. First, the sail is tilted all the way forward. This turns the vessel away from the wind. When the wind is at a right angle to the centerline of the hull, as shown at D, the sail control line 56 is released. The forward motion of the vessel slows to a stop. Sail control line 62 is used to pull the sail toward the opposite end of the boat and it now proceeds to sail on the opposite tack, as shown at E and F.

The invention is adaptable to other types of sailing vessels, i.e. catamarans, monohulls, trimarans. The important difference between these vessels and that chosen as the preferred embodiment is that these other types tack in the conventional manner. To make the invention work on each tack, the upper mast holding means 26 must be duplicated on the other side of the vessel. For this purpose, the "I" beam tracks 34 may be extended past the centerline of the vessel and a duplicate set of upper mast holding means 26 and associated hardware installed.

While present preferred embodiments and practices of the invention have been described and illustrated, the invention may be otherwise variously embodied and practiced within the scope of the following claims.

I claim:

1. A sailing vessel comprising an elongated hull, a mast, a boom pivotally connected at one end to the mast, means to secure the mast and boom to a sail having one side extending along the mast and one part extending near the other end of the boom, and mast supporting and angular adjustment means comprising the following elements operative as follows:

(a) An upper mast holding means connected to the mast;

(b) A lower mast holding means connected to the mast near the bottom end of the mast;

(c) means mounting said lower mast holding means for movement substantially lengthwise of the hull;

(d) means to apply and release restraint on said lengthwise movement while sailing;

(e) means mounting said upper mast holding means for movement substantially sidewise relative to the length of the hull; and (f) means to apply and release restraint on said sidewise movement while sailing;

(g) whereby during restraint of said sidewise movement, said lengthwise movement is effective to tilt the mast in a direction substantially lengthwise of the hull;

(h) whereby during restraint of said lengthwise movement, said sidewise movement is effective to tilt the mast in a direction substantially sidewise relative to the length of the hull; and (i) whereby combinations of said sidewise and lengthwise movements are effective to tilt the mast in directions having both lengthwise and sidewise components relative to the length of the hull.

2. A sailing vessel according to claim 1, comprising a substantially triangular sail having one side secured to substantially the whole length of the mast, and having its other two sides converging toward said other end of the boom.

3. A sailing vessel according to claim 2, in which the connection between the boom and the mast is located between oen eighth and one half of the length of the mast, measured from the bottom of the mast.

4. A sailing vessel according to claim 1, in which the means for mounting the upper mast holding means comprises a connecting structure pivotally connected to the upper mast holding means, a pair of spaced parallel tracks extending sidewise relative to the length of the hull, means mounting said tracks in fixed relation to the hull, a pair of means moveable along the respective tracks and pivotally connected to said structure.

5. A sailing vessel in accordance with claim 4, in which one of said tracks extends toward one end of the line of movement of the lower mast holding means and the other of said tracks extends towards the other end of said line of movement.

6. A sailing vessel in accordance with claim 1, in which said means mounting the lower mast holding means comprises a track curved about the upper mast holding means as a center.

7. A sailing vessel in accordance with claim 6, comprising means supporting said curved track, and pivoted connection means between the hull and the curved track supporting means at opposite ends of the curved track supporting means, said pivotal connections permitting swinging movement of the curved track sidewise relative to the length of the hull.

8. A sailing vessel in accordance with claim 1, comprising an elongated float spaced from and parallel to said hull, and crossbeam structure connecting the hull to the float, said means for mounting the upper mast holding means being connected to the crossbeam structure.

9. A sailing vessel in accordance with claim 8, in which the connection between the means for mounting the upper mast holding means and the crossbeam structure comprises a pair of parallel tracks mounted on the crossbeam structure and extending transversely of the length of the hull, a connecting structure pivotally connected at one end to the upper mast holding means, and a pair of means connected to move along the respective tracks and connected to said structure.

10. A sailing vessel in accordance with claim 2, comprising an elongated float connected to the elongated hull in spaced parallel relation, said hull and float being double ended to sail with equal facility in either direction parallel to the direction of elongation of the hull, and the mast being rotatable more than half a revolution around its axis, the boom and sail being rotatable with the mast to reverse the alignment of the boom and sail relative to the ends of the hull and the lower mast holding means being movable lengthwise of the hull enough to reverse the lengthwise tilt of the mast, whereby the boom and sail alignment and the tilt of the mast may be altered accordingly when the direction of movement of the hull is to be reversed.

11. A sailing vessel in accordance with claim 1, in which the means mounting the upper mast holding means for movement substantially sidewise relative to the length of the hull, comprises support means having portions spaced apart in a direction substantially parallel to the length of the hull and moveable toward and from the mast, and means connecting said upper mast holding means to said portions and extending substantially rigidly therebetween and between said portions.

* * * * *